US005551827A

United States Patent [19]

Menegatto

[11] Patent Number: 5,551,827

[45] Date of Patent: Sep. 3, 1996

[54] DEVICE FOR LOADING AND UNLOADING COPS IN TEXTILE WINDING APPARATUS

[75] Inventor: Carlo Menegatto, Monza, Italy

[73] Assignee: Menegatto S.r.l., Milan, Italy

[21] Appl. No.: 363,521

[22] Filed: Dec. 23, 1994

[30] Foreign Application Priority Data

Dec. 24, 1993 [IT] Italy ..... MI93A2735

[51] Int. Cl.[6] ..... B66F 11/00

[52] U.S. Cl. ..... 414/746.1; 414/745.9; 414/746.4; 414/911; 242/35.5 A; 242/533.2

[58] Field of Search ..... 414/745.9, 746.1, 414/746.2, 746.4, 911; 242/533.1, 533.2, 35.5 A, 18 DD

[56] References Cited

U.S. PATENT DOCUMENTS

| | | | |
|---|---|---|---|
| 3,610,545 | 10/1971 | Reifenhauser | 242/533.1 |
| 4,196,865 | 4/1980 | Patriksson | 242/533.1 |
| 4,451,007 | 5/1984 | Ohkubo et al. . | |
| 4,744,720 | 5/1986 | Kremar | 414/911 |
| 4,767,076 | 8/1988 | Tagawa | 414/911 |
| 5,022,439 | 6/1991 | Yano et al. | 414/911 |
| 5,165,615 | 11/1992 | Polnik | 242/35.5 |
| 5,326,039 | 7/1994 | Tanae et al. | 242/35.5 |

FOREIGN PATENT DOCUMENTS

| | | | |
|---|---|---|---|
| 886319 | 10/1943 | France . | |
| 2663916 | 1/1992 | France . | |
| 351076 | 10/1986 | Germany | 414/911 |
| 3528743 | 2/1987 | Germany | 414/746.2 |
| 59-128128 | 7/1984 | Japan | 414/745.9 |
| 432311 | 9/1967 | Switzerland . | |
| 556784 | 12/1974 | Switzerland . | |

*Primary Examiner*—Karen B. Merritt
*Assistant Examiner*—Douglas Hess
*Attorney, Agent, or Firm*—Young & Thompson

[57] ABSTRACT

Device for loading and unloading cops in textile apparatus for winding yarn of the type comprising a cop-holder arm suitable for picking up a cop, supporting it during the yarn winding operation and transferring it at the end of the operation of yarn winding; the device comprises a guide element for the sliding of the cops which extends from the area of pick-up and transfer of the cops and which moves and can be positioned, driven by a suitable drive mechanism, in a first upper position wherein it defines a loading guide for empty cops and in a second lower position wherein it defines a unloading guide for full cops. Elements are also provided for stopping and positioning the empty cops sliding on the loading guide of the empty cops in a suitable position for pick-up by the cop-holder arm of the textile machine.

12 Claims, 2 Drawing Sheets

DEVICE FOR LOADING AND UNLOADING COPS IN TEXTILE WINDING APPARATUS

FIELD OF THE INVENTION

The present invention relates to a device for the loading and unloading of cops in textile apparatus for winding yarn.

BACKGROUND OF THE INVENTION

The known devices for loading and feeding cops to textile winding apparatus comprise, essentially, a support structure, a first fixed guide for loading cops towards a respective area for pick-up of the cops by suitable arms of the winding machine, and a second fixed guide for unloading the cops which extends from a second area for transfer of the cops loaded with yarn by the arms of the winding machine.

In these known devices the cops, empty and full respectively, are fed and moved away by exploiting the force of gravity, tilting said loading and unloading guides from the work area of the reels upwards, in order to allow sliding towards the pick-up area of the empty cops, and downwards respectively, to allow sliding away from the winding machine of the cops loaded with yarn, with said cop loading guide which is provided in a position above said cop unloading guide and on the side of the machine opposite the latter.

Such a type of device for loading and unloading cops and textile winding apparatus is disadvantageous from various viewpoints.

First of all attention should be drawn to the problem of bulk posed by traditional loading and unloading devices; the fact that chutes or guides for sliding of the cops to be loaded or unloaded are provided and which extend on opposite sides starting from different work areas of the textile machine involves excessive use of space which always represents a problem for all those machines which have to be placed inside industrial buildings which have already been set up.

Moreover, the fact that said cop loading guide or chute is provided on the front side of the machine is disadvantageous, in that it takes up space intended instead for other work devices of the winding machine which must necessarily be provided in the front position of the machine between the yarn guide parts and the reel for collecting yarn.

A feed and guide chute provided in front of the winding machine also interferes with the manoeuvres of the operators in charge of the machine who must deal with the initial operations of inserting the yarn and maintenance of the other devices of the winding machine.

Additionally, said front chutes must necessarily be of limited length since otherwise they would impede the operators' work excessively and could interfere with other functions of the winding machine, for example the function of guiding the yarn towards the winding sections. The fact that long loading and unloading chutes are provided one at the rear and the other at the front of the machine makes said textile machine excessively wide and bulky. The chutes for loading-unloading the cops may only store a limited number of yarn collection cops. Thus the constant presence of the operator is required for loading and removing cops from said loading and unloading chutes.

The object of the present invention is that of providing a device for loading and unloading cops, in textile apparatus for winding yarn, which has small overall dimensions, smaller than those of similar devices already known.

Another object of the present invention is that of providing a device for loading and unloading cops in a textile apparatus, more particularly in a yarn winding apparatus, which does not interfere with the movements or at any rate facilitates the functions performed by additional devices of the textile machine, as well as allowing improved accessibility for the staff in charge of the various components of the winding machine.

Another object of the present invention is that of providing a device for loading and unloading cops which does not require the constant presence of the staff in charge.

A further object of the present invention is that of providing a device for loading and unloading cops which suitably feeds one cop at a time for each winding cycle of a textile machine and accurately positions the same in the pick-up area for an easy grip by the arms of the textile machine.

SUMMARY OF THE INVENTION

The previous objects are achieved with a device for loading and unloading cops in textile apparatus for winding yarn of the type comprising a cop-holder arm suitable for picking up a cop, supporting it during the operation of winding the yarn and for transferring it when the operation has ended; the device comprising: a support structure for a first guide for loading empty cops to the textile apparatus towards a zone for pick-up of the cops by said cop-holder arm and a second cop unloading guide respectively for moving away cops loaded with yarn from the textile apparatus from a zone of transfer of the full cops by a cop-holder arm, in which from the zone of pick-up and transfer of said cops, a guide element extends for the sliding of the cops which is mobile and can be positioned, driven by suitable drive means, in a first upper position wherein it defines said empty cop loading guide and in a second lower position wherein it defines said full cop unloading guide; and in which means are provided for stopping and positioning said empty cops sliding on the empty cop loading guide in a suitable position for pick-up by said cop-holder arm at said zone of pick-up of the cops.

As will be made clearer hereinunder, the fact that a cop guide element is provided which moves to define in a first position said cop loading guide and in a second position said cop unloading guide, allows the cop loading and unloading device to occupy a small volume. In fact it allows empty cops and full cops, at different times, to pass by the same points of the device, enabling a cop loading-unloading device to be obtained with small dimensions and such that it does not impede the other devices of the textile machine.

BRIEF DESCRIPTION OF DRAWINGS

The present invention will be made clearer on reading the following description relating to a preferred embodiment of the invention. The following description must be read with reference to the accompanying drawings in which.

DESCRIPTION OF THE PREFERRED EMBODIMENT

Figure 1:
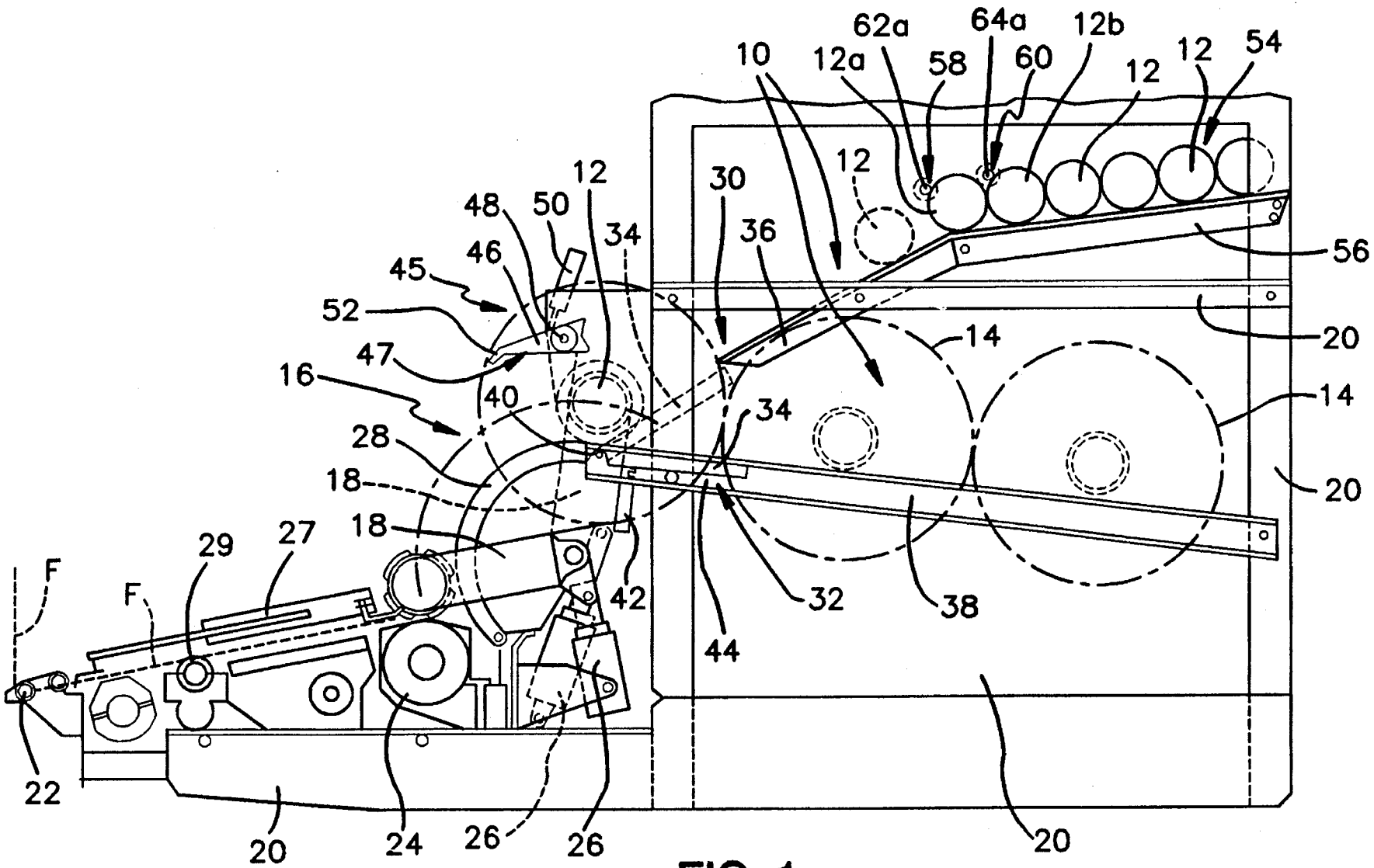
FIG. 1 represents a side view of the device for loading and unloading cops applied to textile winding apparatus.

FIG. 1 shows a device 10 for loading empty cops 12 and unloading cops full of yarn 14 to and from the textile yarn winding machine 16 respectively.

Briefly, the textile winding apparatus 16 comprises a cop-holder arm 18 designed to pick up, in the position shown by a dotted line in FIG. 1, an empty cop 12, and support it during the phase of winding the yarn F, which according to this embodiment is performed in the lowered position of said arm 18, and to return it to said device 10, at the end of the yarn winding operation, in the abovementioned raised position shown by the dotted line.

Of the textile apparatus, in order not to complicate the drawing excessively, only the following are shown: the cop-holder arm 18 in the two abovementioned working positions, the support structure 20, yarn drive parts 22 which guide the yarn towards the collection cop passing through suitable parts for guiding the yarn being wound on the cop (not shown), as well as suitable parts for the movement of the various elements of the winding machine, namely a cop drive roller 24, a cylinder 26 for the movement of the cop-holder arm 18 and an arched guide 28 for said arm 18.

FIG. 1 also shows a device 27 for trapping and inserting yarn on the reel and an oiling device 29 for lubricating the yarn.

The device 10 of the present invention comprises a first guide 30, whereon the empty cops 12 slide for loading of the winding apparatus 16, and a second guide 32 for the sliding of the cops loaded with yarn 14 to be unloaded by the same winding apparatus.

According to the invention, it has been foreseen to perform the operation of picking up and transferring cops by the cop-holder arm 18 in a single point or zone from which a mobile guide element 34 extends and which, in the lowered position, shown by the unbroken line, defines said guide 32 for unloading full cops 14 and in the raised position, shown by a dotted line, defines said guide 30 for unloading empty cops 12.

In this way a considerable reduction in the overall dimensions of the cop loading-unloading device is achieved, in that it is possible to make both the empty cops and the full cops pass at least through the points situated near said pick-up and transfer zone, obviously at different times. This avoids the need to provide totally differentiated paths which have to be considerably distanced one from the other with the two guides for loading and unloading which must extend on opposite sides of the textile machine, involving considerable overall dimensions of these known devices.

In addition, in order not to weigh down said mobile guide element 34 excessively, fixed guide portions 36, 38 have been provided to form a guide element for the empty cops 12 and for the full cops 14 respectively. The fixed guide portions 36, 38 for loading and unloading cops develop on the extension of said mobile guide element 34 and are arranged in the raised position, shown by a dotted line, and in the lower position, shown by an unbroken line, respectively.

Advantageously, the guides for loading and unloading of the cops may be provided on the same side of the textile machine with the guide for loading empty cops arranged above the guide for unloading full cops.

As is clear from FIG. 1, the fixed portion 36 of the upper unloading guide 30 is provided distanced from the underlying lower loading guide 32 so as to allow the passage of the full cops 14 for unloading.

Even if this fact is not expressly shown in FIG. 1, said slide guides of the cops 30, 32 comprise a first and a second lateral track suitable for supporting said cops at the end edges of the latter.

The mobile guide element 34 is hinged at one of its ends in 40, at the cop pick-up and transfer zone, and is driven rotatably to position in the two aforementioned lower and upper positions by drive means formed by a piston contained in a pneumatic cylinder 42.

The mobile element 34 may be attached rotatably to the support structure 20 or advantageously attached to a front extension 44 of said fixed portion 38 of the unloading guide 32.

It is also possible to provide for said mobile guide element 34, in its lower position, to arrange its upper 35 surface for the sliding of the cops below an upper surface 39 of said front extension 44 of the fixed portion of the cop unloading guide 32, so as to discharge said means for driving the movement of the element 34 of the task of positioning precisely said mobile element 34 also in the lower position.

According to the invention means 45 are provided for positioning and stopping the empty cops 12 sliding on the cop loading guide 30. They comprise a mobile part 46 arranged in a position above said cop loading guide 30, at the pick-up and transfer zone. It is attached rotatably in 48, by one of its ends, to said support structure 20.

The mobile part 46 is driven by suitable drive parts, consisting of a piston housed in a pneumatic cylinder 50, to occupy a lowered position (shown by the dotted line) in order to stop and position the cops sliding on said loading guide 32 and in a second raised position (shown by the unbroken line) wherein it allows the free movement of the cop by the cop-holder arm 18 both to take it into the front yarn winding zone and to pass it to the rear of the full cop unloading guide 32.

Although this fact is not expressly shown in FIG. 1, said mobile part for stopping the cops 46 comprises a first and a second lateral arm, suitable for engaging said empty cop 12 at the longitudinal ends of the latter, so as to provide a stop for the cops without the risk of turning them over.

In order to adapt better to the circular shape of said cops 12 so as to provide a better stop for the cops which slide on the loading guide 30, said stopping arms 46 have a cop stop face 47 which is bent with a curve which matches the curve of the cops themselves.

From what has been referred above, it can be seen that stopping of the empty cops 12 in the pick-up position by the reel-holder arm 18 is performed by said stopping parts 46 and by said mobile guide element 34 in their lowered and raised positions respectively.

According to the invention suitable means are provided for feeding empty cops to said cop loading guide, capable of placing, in a cadenced manner, on said guide 30 for loading empty cops, only one cop at a time for each working cycle of yarn winding.

Figure 2:
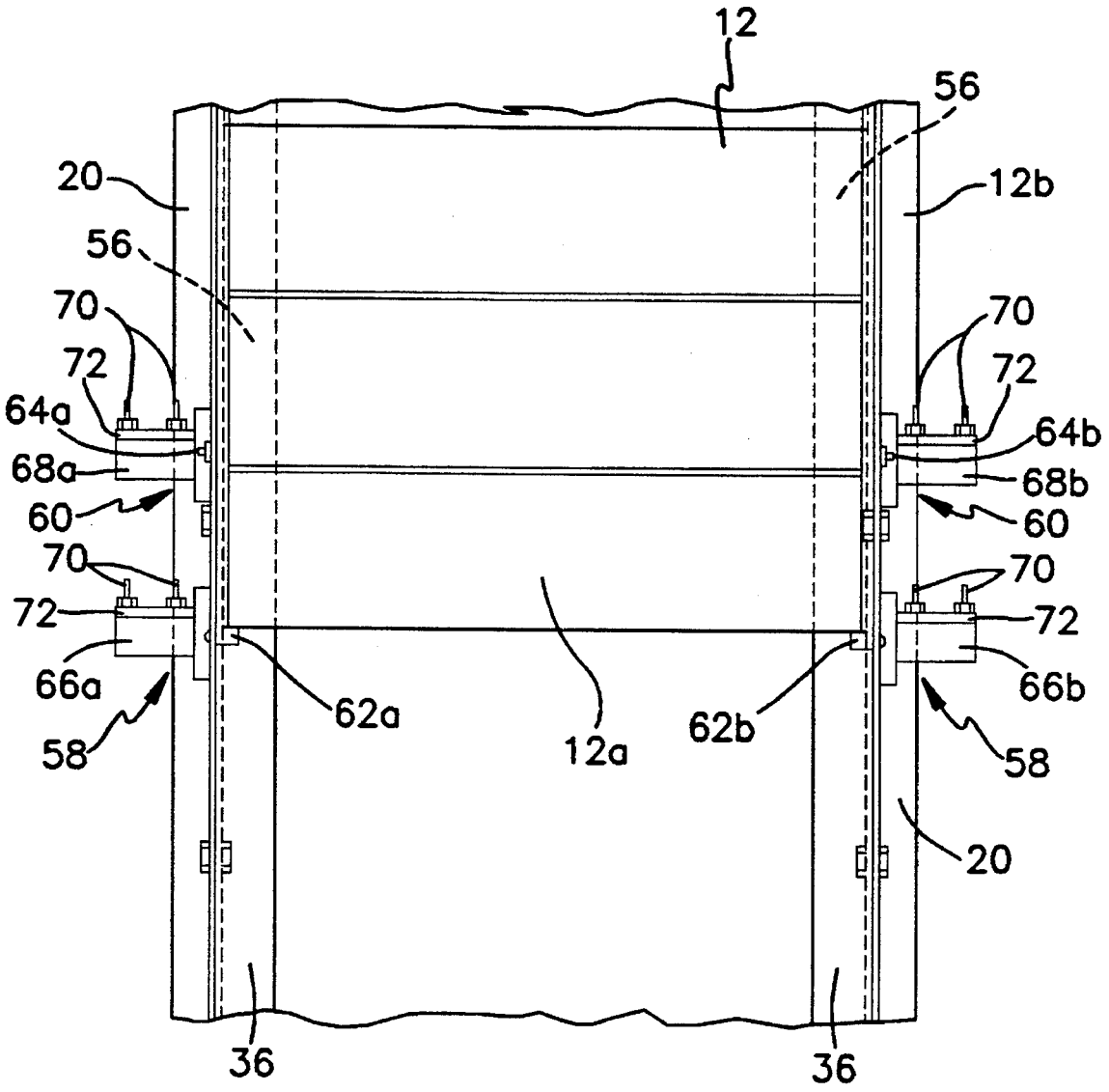
FIG. 2 represents a view from above of a portion of the upper feed guides for empty cops showing in detail the cadenced cop release device.

As is clear also by referring to the detail in FIG. 2, said means for feeding in a cadenced manner the cops to said loading guide comprise a guide 56 for feeding on the extension of said loading guide 30 and arranged tilting downwards, towards the pick-up and transfer zone, with a smaller slant than that of said loading guide 30 and a first and a second stopping device for a line of empty cops 12 located on said feed guide 56, denoted by 58 and 60 respectively in the figures.

The first stopping element 58 is positioned at the first cop **12*a* of the line and defines the point of release of the cops by said cadenced feed means. It is normally actuated to close for the stop of all the cops present on the feed guide 56, while said second stopping element 60 is provided at a certain distance from said first stopping element 58, in a position such that it blocks the second cop 12***b* of the line of empty cops 12. It is normally actuated in an open condition to allow cops to slide freely on the guide 56.

Suitable means are provided for actuating the opening and closure of said stopping elements and are suitable for actuating, following a cop request signal, the simultaneous opening of the first stopping diement 58 and closure of the second stopping element 60, so as to allow the forward movement of the first cop 12*a* of the line of cops towards and onto the loading guide 32 and to block all the remaining cops of the line. Having ended this release operation, said stopping elements return to their normal conditions, the open one for the second stopping element 60, to allow forward sliding of the line of cops, and the closed one respectively for the first stopping element 58, to block the forward sliding of the line of cops.

According to the present embodiment of the invention, each of said first and second stopping elements comprise respectively a first and a second mobile pin 62*a,b* and 64*a,b* each provided at a respective side of said cops. The pins 62*a,b* and 64*a,b* are driven by said drive means into a forward closure position by means of respective drive pistons provided inside respective cylinders 66*a,b* and 68*a,b* which are attached by means of respective screws 70 and brackets 72 to the support structure 20. The Said pistons for driving the stopping pins are actuated by a pressurized fluid under the control of a microprocessor (not shown in the drawings).

Obviously it is clear that what has been written and shown in the accompanying drawings relating to the preferred embodiment of the invention has been given purely by way of a non-limiting example of the principle claimed.

What is claimed is:

1. Device for loading and unloading cops in a textile apparatus for winding yarn and having a cop-holder arm suitable for picking up a cop, supporting said cop during a yarn winding operation, and for transferring said cop when the operation has ended; the device comprising: a support structure including a first guide for loading empty cops to the textile apparatus towards a single zone of pick-up and transfer of said cops by said cop-holder arm and a second guide for unloading and moving away full cops loaded with yarn from the textile apparatus from said zone of pick-up and transfer by said cop-holder arm, said first guide and said second guide extending from said zone of pick-up and transfer; a mobile guide element extending from the zone of pick-up and transfer for sliding the cops, said mobile guide element including drive means for positioning said mobile guide element in a first upper position defining an extension of said first guide for loading empty cops, and in a second lower position defining a portion of said second guide, whereby loading of empty cops and unloading of full cops is achieved by gravity; and means for stopping and positioning said empty cops sliding on the first guide in a suitable position for pick-up by said cop-holder arm at said zone of pick-up and transfer of the cops.

2. Device for loading and unloading cops in a textile apparatus according to claim 1, wherein said first guide and said second guide are provided on a same side of the textile apparatus, and said first guide is positioned above said second guide.

3. Device for loading and unloading cops in a textile apparatus according to claim 2, wherein said first guide and said second guide have respective fixed portions for guiding the cops; and said fixed portion of the upper first guide is distanced from said lower second guide so as to allow said full cops to slide freely on said second guide.

4. Device for loading and unloading cops in a textile apparatus according to claim 3, wherein said mobile guide element is attached rotatably to said support structure at the zone of pick-up and transfer of said cops.

5. Device for loading and unloading cops in a textile apparatus according to claim 4, wherein said mobile guide element is attached rotatably to a front extension of said fixed guide portion of the second guide.

6. Device for loading and unloading cops in a textile apparatus according to claim 5, wherein in the lower position said mobile guide element arranges its surface for sliding of the cops below an upper surface for sliding of the cops of said front extension of the fixed guide portion of the second guide.

7. Device for loading and unloading cops in a textile apparatus according to claim 1, wherein said means for stopping and positioning the empty cops comprise a mobile part for stopping the cops sliding along the first guide, attached to said support structure above said first guide at said zone of pick-up and transfer of the cops, said mobile part being actuated and positioned by drive means in a first lower position for stopping the cops sliding on said first guide and a second raised position for allowing free movement of a cop.

8. Device for loading and unloading cops in a textile apparatus according to claim 7, wherein said mobile part for stopping the cops comprises first and second lateral arms jointed at one of their ends to said support structure.

9. Device for loading and unloading cops in a textile apparatus according to claim 8, wherein said lateral arms have a face for stopping cops which is curved so as to adapt to a circular shape of said cops.

10. Device for loading and unloading cops in a textile apparatus according to claim 1, further including means for feeding cops to said first guide and for placing on said first guide one single cop at a time for each working cycle of the textile apparatus.

11. Device for loading and unloading cops in a textile apparatus according to claim 10, wherein said means for feeding cops to said first guide comprises a cop feed guide on an extension of said first guide, and a first stopping element for a line of empty cops placed on said feed guide, said first stopping element being positioned in a normally closed condition for stopping said line of cops sliding on said feed guide, and for stopping a first cop of the line; and a second stopping element for blocking said line of cops from sliding on the feed guide, said second stopping element being positioned in a normally open condition for allowing free sliding of the cops on the feed guide, and for blocking a second cop of the line; and drive means for opening and closing respectively said first stopping element and said second stopping element to allow forward movement of only the first cop of the line of cops on the feed guide towards said first guide.

12. Device for loading and unloading cops in a textile apparatus according to claim 11, wherein each of the first and second stopping elements comprises a first and a second mobile pin, each pin being provided at a respective side of said cops, and means for driving said pins in a forward position to prevent sliding of the cops on the feed guide, and in a backward position to allow forward movement of said cops.

* * * * *